US005373905A

United States Patent [19]

Bleicher et al.

[11] Patent Number: 5,373,905

[45] Date of Patent: Dec. 20, 1994

[54] HAMMER DRILL

[75] Inventors: Manfred Bleicher, Leinfelden-Echterdingen; Ulrich Bohne, Kohlberg; Volker Lasch, deceased, late of Stuttgart, all of Germany, by Hugo Lasch administrator

[73] Assignee: Robert Bosch GmbH, Stuttgart, Germany

[21] Appl. No.: 989,005

[22] PCT Filed: Jul. 6, 1992

[86] PCT No.: PCT/DE92/00559

§ 371 Date: Nov. 8, 1993

§ 102(e) Date: Nov. 8, 1993

[87] PCT Pub. No.: WO93/01027

PCT Pub. Date: Jan. 21, 1993

[30] Foreign Application Priority Data

Jul. 8, 1991 [DE] Germany ..... 4122516
May 9, 1992 [DE] Germany ..... 4215288

[51] Int. Cl.[5] ..... B25D 11/04
[52] U.S. Cl. ..... 173/109; 173/122
[58] Field of Search ..... 173/109, 104, 111, 122, 173/205

[56] References Cited

U.S. PATENT DOCUMENTS

| | | | |
|---|---|---|---|
| 3,828,863 | 8/1974 | Bleicher et al. | 173/122 |
| 3,874,460 | 4/1975 | Schmid et al. | 173/109 |
| 4,719,976 | 1/1988 | Bleicher et al. | 173/109 |
| 4,750,567 | 6/1988 | Grossmann et al. | 173/109 |

FOREIGN PATENT DOCUMENTS

| | | |
|---|---|---|
| 3828309 | 2/1990 | Germany . |
| 2171631 | 9/1986 | United Kingdom . |

*Primary Examiner*—Scott A. Smith
*Attorney, Agent, or Firm*—Michael J. Striker

[57] ABSTRACT

A hammer drill has a three-part hammering sleeve. A hardened tool socket is attached to a guide tube made of unhardened steel by an axial connection. For connection to the driving gearwheel, the guide tube furthermore carries a latching ring fixed on the guide tube by three rollers which make possible good torque transmission. This construction has the advantage that it is no longer necessary to harden the entire hammering sleeve but only the tool socket and the latching ring. The guide tube can be composed of soft steel. The connections and ensure large-area transmission of force, wear on the soft guide tube caused by conventional connection techniques thereby being avoided.

17 Claims, 3 Drawing Sheets

HAMMER DRILL

BACKGROUND OF THE INVENTION

The present invention relates to a hammer drill.

More particularly, it relates to a motor-driven hammer drill which has a casing and a multi-part hammering sleeve with a guide tube and a tool socket driven in rotation by a motor.

DE 38 28 309 C2 discloses a hammer drill in which, contrary to the customary design, the guide tube for the striking mechanism and the tool socket is in two parts. The two parts are connected by locking elements which, in the form of balls, engage in recesses in both parts, this entailing high point loading of the parts. For this reason, it was necessary to heat-treat or harden both the guide tube and the tool socket. Moreover, the construction requires a high constructional outlay.

SUMMARY OF THE INVENTION

Accordingly, it is an object of the present invention to provide a hammer drill which avoids the disadvantages of the prior art.

In keeping with these objects and with others which will become apparent hereinafter, one feature of the present invention resides, briefly stated, in a motor-driven hammer in which the tool socket is attached to the hammering sleeve by means of an axial connection which has a resilient slotted profiled ring which, in its assembled position, can be inserted completely under radial prestress into an annular assembly groove, and with the hammering sleeve fully assembled engages in an annular groove of the component to be connected, and the annular assembly groove has a bearing surface set obliquely to a normal to the longitudinal axis of the tool socket against which bearing surface the profiled ring rests with the hammering sleeve fully assembled.

When the motor-driven hammer is designed in accordance with the present invention, it has the advantage that the high axial forces deriving from the striking mechanism are transmitted over a larger area. This makes possible the use of an unhardened guide tube, hardening distortion and finishing work on the guide tube thereby being avoided. Not least, the lower weight of the components to be hardened is also accompanied by a significant reduction of the burden on the environment by the elimination of hardening steps.

The use of a resilient profiled ring and corresponding grooves, preferably of matching shape, in the guide tube and in the tool socket avoid shear stresses on the connecting element, with the result that the profiled ring is only subjected to compressive stress and the pressures which occur between "hard" and "soft" components are not in the form of point loads but only of loads distributed over a surface. By running-in during operation, at the very latest, the grooves adapt precisely to the shape of the profiled rings, with the result that they bear the loads with their entire surface. The axial connection according to the invention has the further advantage that the hammering sleeve is easy to produce by plug-in assembly and that satisfactory truth of running of the tool holder is guaranteed.

Advantageous further developments and improvements of the hammer drill are possible. In its oblique position relative to the longitudinal axis, the bearing surface can be flat or, alternatively, have a concave curvature in order to adapt to the outer contour of the profiled ring used. The profiled ring can, in particular, have a circular or oval, rectangular or some other cross-section.

It is particularly advantageous to transmit the torque required at the tool socket via a press fit since only limited forces can be transmitted in the circumferential direction via the profiled ring. Also advantageous is a latching ring as a coupling part for a safety clutch, the ring being secured by means of a plurality of rollers which rest in linear fashion in recesses, of which there are preferably three. This makes the latching ring easy to exchange in the event of wear. While providing the possibility of easy manufacture, the rollers make it possible to transmit the torque well between the latching ring and the guide sleeve. To provide axial securing, a round ring can preferably be additionally fitted in the guide tube, resting, if required under prestress, against a chamfer of the latching ring. The overall construction makes it possible to use a seamlessly drawn or welded soft piece of tube as the guide tube and this reduces the manufacturing costs considerably.

The construction according to the invention has the further advantage that the connecting means between the guide tube and the tool socket and latching ring are very economical on space and make possible a hammering sleeve which is as thin-walled as one-piece embodiments. The connections thus require no additional space, in contrast to the solution in accordance with DE 38 28 309 C2.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
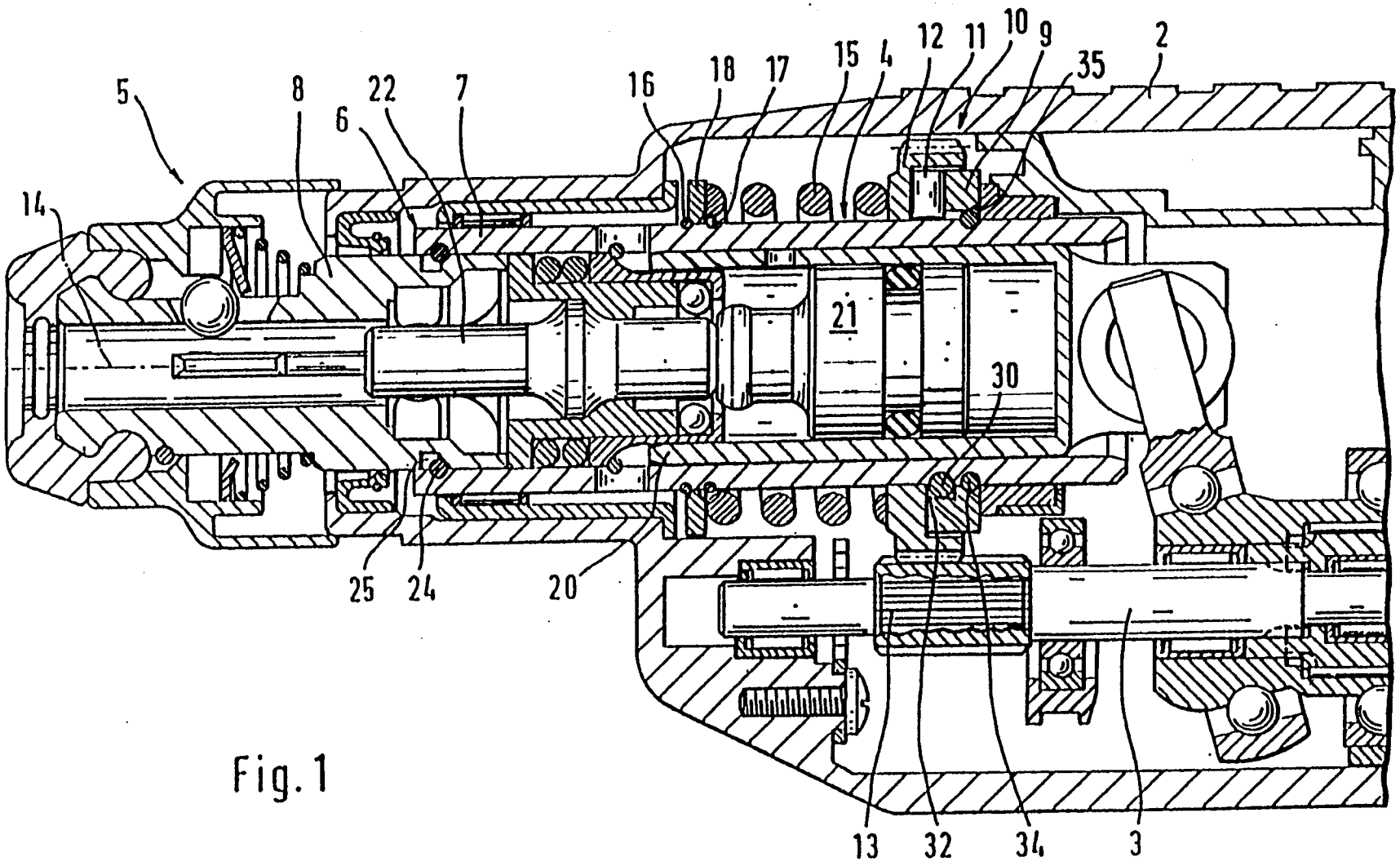
FIG. 1 shows a longitudinal section through the front part of a hammer drill.

A hammer drill has a plastic casing 2 in which is accommodated a motor (not shown) which drives an intermediate shaft 3. Also accommodated in the casing 2 is a striking mechanism 4, at the front end of which is arranged a tool holder 5. The striking mechanism 4 lies within a three-part hammering sleeve 6 which comprises a guide tube 7, a tool socket 8 with a longitudinal axis 14 and a latching ring 9. The striking mechanism 4 is guided in the guide tube 7, which is mounted in the casing 2 and is designed as a seamlessly drawn or welded unhardened piece of tube.

Connected to the guide tube 7 is the tool socket 8, which is likewise essentially tubular, forms part of the tool holder 5 and into which a tool (not shown) is directly inserted. The tool socket 8 can rest against the inside of the guide tube 7 ( as in FIG. 1 ) or against its outside. Seated on the guide tube 7 there is furthermore the latching ring 9, which serves as part of a safety slip/latch 10. As driving elements, the safety clutch 10 has, in a known manner, rollers 11 which interact with latching grooves in the hardened latching ring 9 and with a gearwheel 12. The gearwheel 12 can be rotated relative to the guide tube 7 and engages in a toothing 13 of the intermediate shaft 3. The two parts 9 and 12 of the safety clutch 10 are pressed together by a compression spring 15 which determines the latch-slipping torque of the clutch. The compression spring 15 is secured in a known manner by means of a supporting washer 18 held by round rings 16, 17 in the guide tube 7.

Situated within the guide tube 7 is the striking mechanism 4, which has a cup-shaped piston 20, driven in reciprocating fashion, and a striker 21 situated therein. The energy of the striker 21 driven by the piston 20 is transmitted to an anvil 22 and from there to a tool (not shown). The piston 20 is guided in the guide tube 7.

The guide tube 7 and the tool socket 8 overlap in a certain region and are there connected to one another by means of a press fit. Careful machining of the easily accessible contact faces of the press-fit connection simultaneously guarantees good truth of running of the tool holder. Particularly for securing the two parts axially, a slotted, resilient profiled ring 24 is additionally inserted (cf. also FIG. 2). This is inserted under prestress into an annular assembly groove 25 in the tool socket 8 which can fully accommodate the profiled ring 24. See in this connection the assembly position 26 (shown in broken lines) of the profiled ring. The annular assembly groove 25 runs out on one side in a bearing surface 27 sloping by 30°–60° preferably 45° obliquely to the longitudinal axis 14. In the case of a profiled ring 24 with a round cross-section, the bearing surface can also be rounded or concave, but in such a way that at least a part of the bearing surface 27, the part which accepts compressive forces, is inclined by approximately the said angle to the longitudinal axis 14. The guide tube 7 has an annular groove 28 preferably matched to the respective profile of the hardened profiled ring 24. The profiled ring 24 here has a circular cross-section and the annular groove 28 has a semicircular cross-section. With the hammering sleeve 6 fully assembled, the profiled ring 24 expands, with the result that it rests with positive engagement in the annular groove 28 and force transmission can take place over an extended area. With its inner side, the profiled ring rests against the bearing surface 27 (see force arrow F1).

Figure 2:
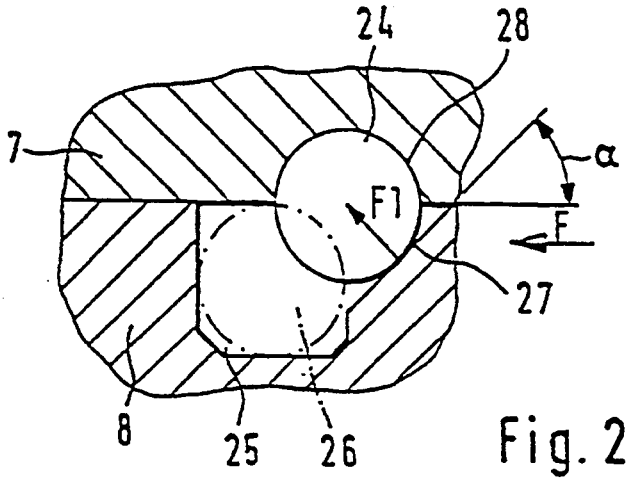
FIG. 2 shows an axial connection on an enlarged scale and FIG. 3 shows a perspective view of a hammering sleeve.

During the operation of the striking mechanism 4, high instantaneous loads in the direction of the arrow F in FIG. 2 occur at the axial connection, particularly during the transition to no-load operation. Due to the inclination of the bearing surface 27, this leads to a compressive stress in the direction of the arrow F1. As a result, the soft guide tube 7 is not stressed primarily at the sensitive edge of the annular groove 28 but continues to be stressed predominantly in the bottom of the groove. Shear stressing of the profiled ring 24 is also avoided by means of this design.

Figure 3:
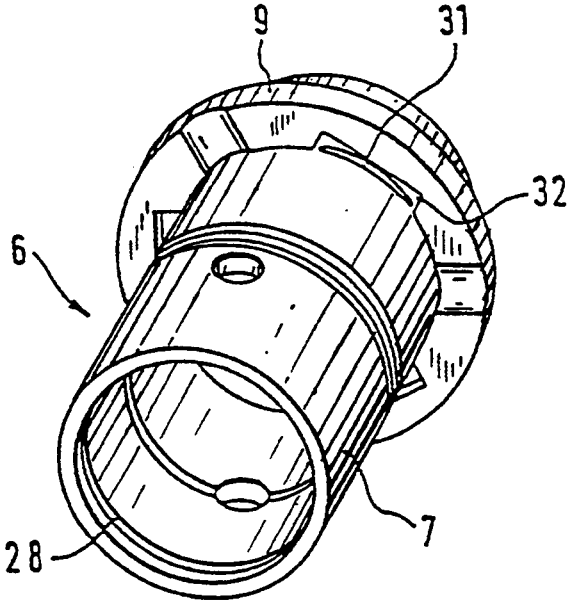

The latching ring 9 is connected to the guide tube 7 via three elongate rollers 30. The rollers 30 rest in the guide tube 7 in three rectilinear notches 31 running out at the ends and having a semicircular cross-section (see FIG. 3, in which the rollers 30 have been omitted). The latching ring 9 correspondingly has three rectilinear recesses 32. During assembly, the rollers 30 are first of all placed in the notches 31 and the latching ring 9 is then pushed over them. To fix the latching ring axially, an elastic round ring 34 is inserted into a groove in the guide tube 7 from the opposite side, i.e. from behind. The round ring 34 rests against a chamfer 35 of the latching ring 9. With this construction, the latching ring 9 can be detached and, if required, exchanged by removing the round ring 34.

In another illustrative embodiment, which is not shown, the hammering sleeve is in two parts and comprises a tool socket and a guide sleeve with an integrally formed latching ring for torque transmission. Otherwise, the construction is the same, in particular as regards the axial connection, as the illustrative embodiment shown in the drawing. A two-part design too has the advantage that a high-grade material has to be used only for the tool socket and the guide tube does not have to be subjected to a full heat treatment. This in itself furthermore considerably simplifies and cheapens manufacture. A further advantage lies in the fact that, with a two-part and, indeed, with a three-part hammering sleeve, the components situated in the region of the anvil can be installed either from the front or from behind. This is not possible in the case of a one-part design.

Figure 4:
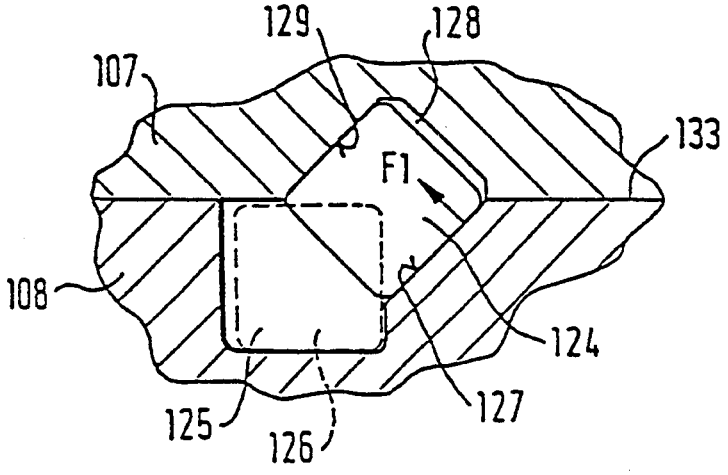
FIG. 4 shows a second illustrative embodiment.

In the second illustrative embodiment according to FIG. 4, the profiled ring 124 has a square cross-section. The annular assembly groove 125 with its bearing surface 127 is unmodified relative to the first illustrative embodiment. The assembly position 126 of the profiled ring 124 is drawn in broken lines. Obliquely opposite the bearing surface 127, the annular groove 128 likewise has a similar, flat, inclined bearing surface 129. Otherwise, the annular groove 128 is delimited in such a way that it cannot accommodate the profiled ring 124 fully but can accommodate it only partially in an oblique position. During assembly of the axial connection, this leads inevitably to the desired tilting of the profiled ring 124, with the result that, as in the first illustrative embodiment, the said ring is stressed obliquely to the join 133 between the guide tube 107 and the tool socket 108, in the direction of the force F1. When the tool holder 108 is subjected to axial blows, the grooves 125 and 128 are in the same way not stressed primarily at their sensitive edges but continue to be stressed in the bottom of the groove.

Reversing the arrangement given in the illustrative embodiments shown, the axial connection by means of the profiled ring 24/124 can also be designed in such a way that the annular assembly groove is in the outer tubular part. The profiled ring is then inserted under prestress in the form of a pre-elongation and contracts again after the tubular parts have been fitted together.

It will be understood that each of the elements described above, or two or more together, may also find a useful application in other types of constructions differing from the types described above.

While the invention has been illustrated and described as embodied in a motor-driven hammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

In the claims:

1. A motor-driven hammer, comprising a casing; a multi-part hammering sleeve located in said casing and driven in rotation, said multi-part hammering sleeve having a guide tube and a tool socket connected with one another;

and means for axially connecting said tool socket with said guide tub, said connecting means including an annular assembly groove provided in one of said tool socket and said guide tube, an annular counter groove provided in another of said tool socket and guide tube, and a resilient slotted profiled ring which, under radial prestress in a prestress in a preassembled position, is fully received within said annular assembly groove and, with the hammering sleeve fully assembled, is engageable in said annular counter groove, said annular assembly groove having a bearing surface which extends obliquely from a longitudinal axis of said tool socket, wherein said profiled ring rests against said bearing surface with said hammering sleeve fully assembled.

2. A motor-driven hammer as defined in claim 1; and further comprising a motor and a gear wheel through which said motor rotatably drives said hammering sleeve.

3. A motor-driven hammer as defined in claim 1, wherein said annular assembly groove is provided in said tool socket while said annular counter groove is provided in said guide tube.

4. A motor-driven hammer as defined in claim 1, wherein said bearing surface is substantially flat and is inclined obliquely to the longitudinal axis of said tool socket at an angle of 30°–60°.

5. A motor-driven hammer as defined in claim 4, wherein said bearing surface is inclined obliquely to the longitudinal axis of said tool socket at an angle of 45°.

6. A motor-driven hammer as defined in claim 1, wherein said profiled ring has a circular cross-section and an outer contour, said bearing surface contacting said outer contour of said profiled ring.

7. A motor-driven hammer as defined in claim 1, wherein said tool socket and said guide tube are rotationally connected by a press fit.

8. A motor-driven hammer as defined in claim 1; and further comprising a latching ring and a plurality of rollers by which said latching ring is connected to said guide tube, said latching ring being provided with recesses in which said rollers rest in linear fashion.

9. A motor-driven hammer as defined in claim 8, wherein said latching ring is formed as a part of a safety slip/latch.

10. A motor-driven hammer as defined in claim 8, wherein said latching ring has three said recesses.

11. A motor-driven hammer as defined in claim 10, wherein said latching ring has a chamfer; and further comprising a round ring by which said latching ring is held axially on said guide tube.

12. A motor-driven hammer as defined in claim 1, wherein said guide tube has at least one depression; wherein said resilient slotted profiled ring rests against said guide tube in said at least one depression.

13. A motor-driven hammer as defined in claim 12, wherein said at least one depression is an annular groove in said guide tube.

14. A motor-driven hammer as defined in claim 12, wherein said at least one depression is a notch in said guide tube.

15. A motor-driven hammer as defined in claim 1, wherein said guide tube is composed of a soft unhardened steel.

16. A motor-driven hammer as defined in claim 1, wherein said guide tube is a seamlessly drawn tube.

17. A motor-driven hammer as defined in claim 1, wherein said guide tube is a welded tube.

* * * * *